United States Patent [19]

Main

[11] Patent Number: 4,791,837

[45] Date of Patent: Dec. 20, 1988

[54] SPEED WRENCH AND HAND GRIP COMBINATION

[76] Inventor: Harvey M. Main, P.O. Box 376, South Fork, Colo. 81154

[21] Appl. No.: 919,838

[22] Filed: Oct. 16, 1986

[51] Int. Cl.[4] ..... B25B 13/46

[52] U.S. Cl. ..... 81/63.1; 81/177.1

[58] Field of Search ..... 81/58.1, 62, 63, 63.1, 81/63.2, 177.2, 492, 489; D8/25, 29, 177.1, 177.3, 177.85

[56] References Cited

U.S. PATENT DOCUMENTS

| | | | |
|---|---|---|---|
| 1,619,043 | 3/1927 | Scheiwer | 81/63.1 |
| 2,512,232 | 6/1950 | Hart | 81/63 X |
| 2,565,961 | 8/1951 | Godfrey | 81/63 X |
| 2,851,915 | 9/1958 | Martinez | 81/177.2 |
| 2,891,434 | 6/1959 | Lozensky | 81/63 X |
| 3,823,624 | 7/1974 | Martin | 81/58.1 |
| 4,135,847 | 1/1979 | Hemmings | 408/226 |
| 4,212,336 | 7/1980 | Smith | 81/58.1 X |

FOREIGN PATENT DOCUMENTS

| | | | |
|---|---|---|---|
| 916097 | 11/1946 | France | 81/124.6 |

*Primary Examiner*—James G. Smith

*Attorney, Agent, or Firm*—Timothy J. Martin; J. Preston Oxenham

[57] ABSTRACT

A speed wrench and complimentary hand grip is provided. The wrench includes a casing which mounts a standard drive mechanism which has a drive member axially projecting from the casing in order to engage a work piece. The wrench has an added feature in the form of a drive head rigidly attached to the casing axially thereof on a side opposite the drive member. The drive head has parallel exterior sides and an interior axial cavity. Thus, the wrench may be torqued by both a normal auxillary wrench having a wrench head that engages the exterior sides by a normal lug wrench which has a drive lug that may mateably engage the cavity. The complimentary handle is in the form of a shell that nestably receives the wrench. The handle has an axial opening sized to receive the drive head whereby rotation of the handle rotates the wrench. The opening also allows access to the drive head cavity while the handle and wrench are nested.

16 Claims, 2 Drawing Sheets

SPEED WRENCH AND HAND GRIP COMBINATION

BACKGROUND OF THE INVENTION

The present invention relates to an improved tool which is adapted to rotatably drive a work piece into an auxillary hand grip which permits operation of the tool with greater comfort and mechanical advantage. More particularly, the present invention is constructed as an improved speed wrench which operates through a ratchet mechanism having an output or drive shaft that receives a tool element, such as a socket or other rotatable tool, in order to rotatably drive a work piece.

Numerous tools adapted to rotatably drive a work piece, such as screws, bolts, nuts and the like, have been developed in the past. These prior art tools include the common screwdrivers, wrenches, nut drivers, adjustable wrenches, socket wrenches, to name a few. Of particular interest to the present invention is the tool device known as a speed wrench wherein a reversible ratchet mechanism is carried within a generally cylindrical casing from which an output or drive shaft outwardly projects. A socket selected from a socket set having various socket openings sized to receive differently dimensioned bolt heads or nuts is then removably secured on the drive shaft. The existing speed wrench tools are typically fairly small, hand held units which may be used to quickly tighten or loosen a bolt or nut, even in confined regions. However, due to the relatively small size, the user of a speed wrench often cannot tighten the bolt or nut to the desired torque since no lever arm or handle is formed on the speed wrench in order to get mechanical advantage. It is precisely this omission of a lever handle which distinguishes a speed wrench from the closely related ratchet wrench which is used with the same socket set. Accordingly, when the user of the speed wrench desires to rotatably drive a bolt or nut with substantial torque, the user removes the speed wrench and employs a second tool, such as a ratchet wrench, an adjustable wrench, or the like, constructed to give a mechanical advantage about the axis of rotation. Use of the auxillary tool requires that the speed wrench be removed from the work piece, after which the auxillary tool is registered with the work piece so that its drive head registers with and engages the work piece. This removal and engagement of an auxillary tool is often time consuming, and is especially difficult where access to the bolt head or nut is difficult.

Thus, even though speed wrenches and other rotatable tool devices are well known in the prior art, there remains a need for an improved tool which may be used to quickly tighten or loosen a bolt or nut, yet which may remain and act as a torque transfer member so that a second tool may be used to increase the mechanical advantage in applying torque around the rotation axis. There is further a need for such an improved tool, including an improved speed wrench, wherein a complementary hand grip may be employed both to facilitate use of the tool, increased comfort to the user and to increase the mechanical advantage which the user enjoys with the tool. There is further a need for such a hand grip which does not interfere with the application of even further increased mechanical advantage by means of an additional tool.

SUMMARY OF THE INVENTION

It is an object of the present invention to provide a new and useful improvement to a manually rotatable tool device so that an auxillary tool may be applied to the device to gain mechanical advantage during rotation without removing the device from a work piece to be turned.

It is another object of the present invention to provide an improved speed wrench device which includes structure to allow application of an auxillary wrench in order to gain mechanical advantage in rotating the device about its drive axis so that a work piece may be tightened or loosened with increased torque.

It is a still further object of the present invention to provide a novel and useful speed wrench device which includes structure to allow the device to be driven by an auxillary wrench and which includes a complimentary removable hand grip which nestably mates with the speed wrench in order to increase the comfort to the user and to allow the user to increase torque while rotating a work piece.

It is yet a further object of the present invention to provide a speed wrench having structure to allow application of an auxillary wrench in order to allow the user to increase rotational torque, and which includes a complimentary hand grip which may nestably receive the speed wrench without interfering with the ability to employ an auxillary torque wrench.

The preferred form of the invention, therefore, provides an improvement to a tool that is adapted to rotatably drive a work piece. The invention is described with respect to a speed wrench, but the present invention contemplates an improvement to tools in general where such tools have a drive mechanism with a drive member projecting axially from one side of the casing to selectively engage a work piece whereby rotation of the casing rotates the work piece. The improvement comprises a drive head that is rigidly attached to the tool in such manner that the drive head projects axially from the casing on a side opposite of the drive member. The drive head has a raised surface oriented generally in a plane transverse to the common axis of the drive member and the drive head, and the drive head has a plurality of flat exterior sides which are oriented in planes generally parallel to the common axis. The flat exterior sides are organized as pairs of sides which are parallel to one another in order to be engaged by the work head of an auxillary wrench. An axially oriented cavity is formed in the drive head through the raised surface with the cavity having a plurality of flat interior sidewalls oriented along interior planes which are parallel to the common axis. Accordingly, a common ratchet wrench having a drive shank configured to engage the cavity may be used in order to turn the tool with mechanical advantage.

In the preferred form of the present invention, a speed wrench apparatus includes a reversible ratchet mechanism contained within a general cylindrical casing which includes a drive shaft which projects on one side of the casing in order to engage a standard socket from a socket wrench set. A strap-like bail is rigidly secured to the casing so that the strap-like bail stands the side of the casing opposite the drive shaft and is rigidly secured at selected locations along the edge of the casing. The bail axially and rigidly mounts the drive head, with the drive head preferably having a predominantly hexagonal configuration such as a common bolt head or nut. Preferably, the cavity formed in the drive head is square-shaped in cross section and sized to correspond to a common square-shaped shank which is provided, for example, on a standard ratchet wrench.

In either the general embodiment of a tool device or in the specific embodiment of a speed wrench, an auxillary hand grip may be provided with the hand grip configured to nestably receive the tool device. The hand grip comprises a shell having an outer surrounding side wall which engages the casing in a nested state, and comprises a cap portion originally attached to the surrounding side wall. The cap portion has an axial opening configured and oriented to mateably receive the drive head in the nested state so that, when the hand grip is rotated, the cap portion engages and drives the drive head to rotate the tool. In order to align the hand grip with the tool, the drive head includes registration means, such as flattened corners in the general hexagonal configuration of the head so that the hand grip may only be mated with a tool in selected rotational orientations. A detent structure may be provided to resilienty resist removal of the hand grip from the tool. The hand grip is formed of an integrally molded, high impact plastic, and may include a strengthening infrastructure of metal, with the a portion of the metal infrastructure directly engaging the drive head when the hand grip tool are in the nest state.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
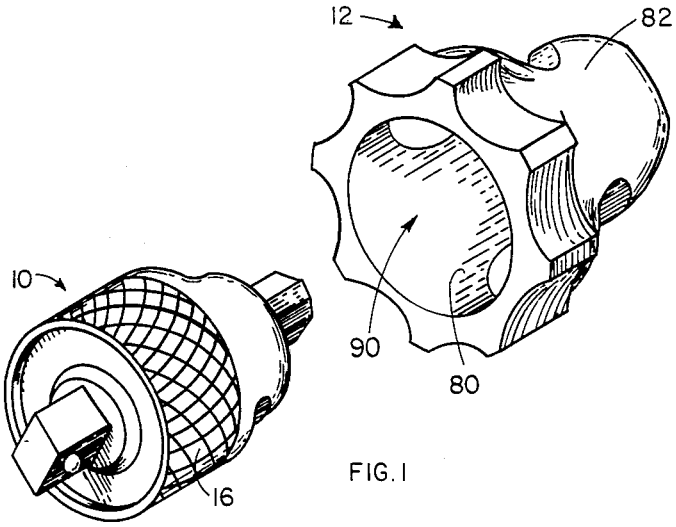
FIG. 1 is a perspective view of improved speed wrench and hand grip according to the preferred embodiment of the present invention in a position just prior to being nested together.

The present invention is directed to tool devices, and particularly to tools adapted to be manually rotated in order to rotatably drive a work piece. Thus, the present invention is specifically useful in combination with a speed wrench device, as an improvement thereto. The improvement according to the preferred embodiment of the present invention, then, includes a drive head structure which is rigidly secured to the speed wrench or other tool so that the user may employ an auxillary lever-type wrench to apply increased torque to the tool. A complimentary hand grip is also provided in the preferred embodiment of the present invention, both for the comfort of the user and in order to allow the user to gain some additional mechanical advantage in rotating the tool. In FIG. 1, the preferred form of the present invention is shown as a combination of an improved speed wrench 10 and a complimentary hand grip 12. The construction of improved speed wrench 10 is best shown in FIGS. 2–4, and the construction of hand grip 12 is best shown in FIGS. 5–8.

Figure 2:
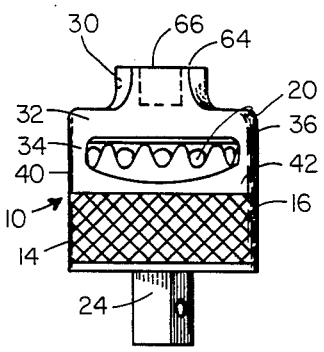
FIG. 2 is a side view in elevation of the speed wrench shown in FIG. 1.
Figure 3:
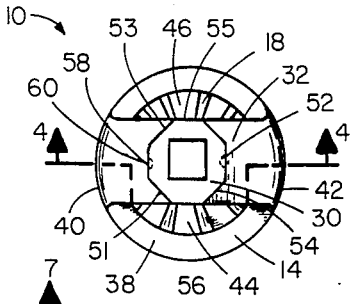
FIG. 3 is a top plan view of the speed wrench shown in FIG. 2.
Figure 5:
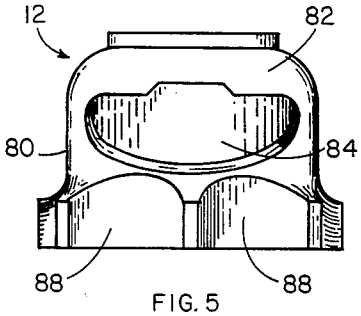
FIG. 5 is a side view in elevation of the hand grip shown in FIG. 1.
Figure 6:
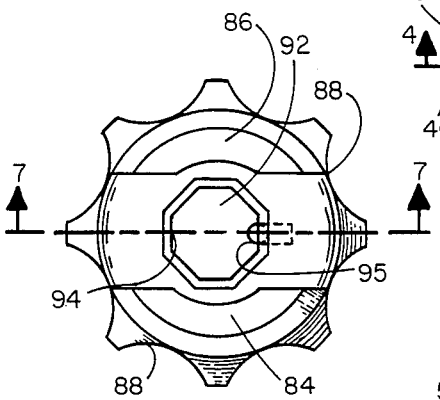
FIG. 6 is a top plan view of the hand grip shown in FIG. 5.
Figure 4:
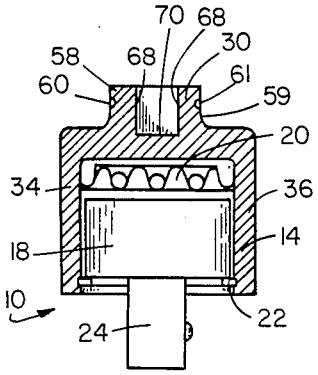
FIG. 4 is a view in partial cross-section taken about lines 4—4 of FIG. 3.

As is shown in FIGS. 2–4, speed wrench 10 has an outer casing 14 which is preferably in the form of a generally cylindrical surrounding sidewall which has an external surface provided with knurling 16. A drive mechanism 18 is received in the interior of casing 14, with drive mechanism 18 preferably being a reversing ratchet mechanism of any of the numerous types known in the art. To this end, a reversing member 20 operates to switch the reversing ratchet mechanism 18 between opposite drive directions; the structures of the mechanism 18 and element 20 are not shown and do not form part of this invention. Drive mechanism 18 is held into position within the interior of casing 14 by means of a spring clip 22, shown in FIG. 4.

Drive mechanism 18 includes a shank or drive member 24 which projects axially from one side of casing 14 and is adapted to selectively mount a tool element, such as a socket, in order to engage a work piece so that the work piece may be correspondingly rotated upon rotation of casing 14 and drive mechanism 18. It should be appreciated, though, for the scope of the present invention, drive member 24 could be constructed as a tool element which directly engaged the work piece. To this end, it is entirely within the scope of the present invention that drive member 24 be configured as a nut driver, a screwdriver, or any other tool that is normally used to rotate a work piece. As is shown in FIGS. 2 and 4, drive member 24 is provided with a ball detent 26 so that a tool element, such as a socket, may be releasably retained on drive member 24.

The improvement according to the preferred embodiment of the present invention includes a drive head 30 which is rigidly secured to speed wrench 10 by means of a strap-like bail 32 that has end portions 34 and 36 which are rigidly attached to an upper edge 38 of casing 14. To this end, end portions 34 and 36 are secured at opposite diametric edge portions 40 and 42 of edge 38, respectively. Since bail 32 extends diametrically across a second side of casing 14 opposite drive member 24, a pair of openings 44 and 46 are formed between bail 32 and edge 38 of casing 14. Openings 44 and 46 allow ready access to reversing member 20 so that reversing member 20 may be manipulated in order to change the drive direction of reversing ratchet mechanism 18.

As is best shown in FIG. 3, drive head 30 is preferably formed as a post having pairs of flat exterior sides. Drive head 30 is a generally hexagonal piece having flat exterior sides 51–56 which are generally oriented in planes parallel to the common axis of drive member 24 and drive head 30. A pair of flattened portions 58 and 59 are located opposite one another and are provided with dimples 60 and 61, respectively. Exterior sides 51 through 56 are organized as substantially planar pairs of sides, such as pair 51,52, pair 53,54 and pair 55,56.

Drive head 30 is oriented axially of casing 14 so that it is along a common axis with drive member 24. Drive head 30 terminates in a raised surface 64 that is generally oriented in a plane transverse to the common axis of drive head 30 and drive member 24, a cavity 66 is formed in raised surface 64 and projects inwardly and axially of drive head 30. Preferably, cavity 66 is square-shaped in cross-section so that it has flat interior sidewalls 68 and a bottom wall 70. Sidewalls 68 are, accordingly, oriented along planes generally parallel to the common axis of drive head 30 and drive member 24. Cavity 66 could take on other geometrical configurations, in order to match conventional drive lugs of lever-type wrenches. For example, cavity 66 could have a hexagonal cross-section to receive a hexagonal lug.

Figure 9:
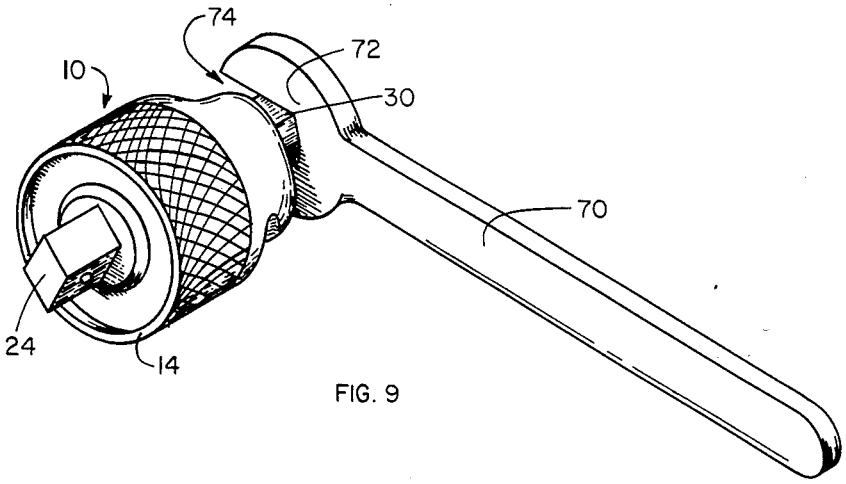
FIG. 9 is a perspective view of an open end wrench engaging the speed wrench shown in FIG. 2.
Figure 10:
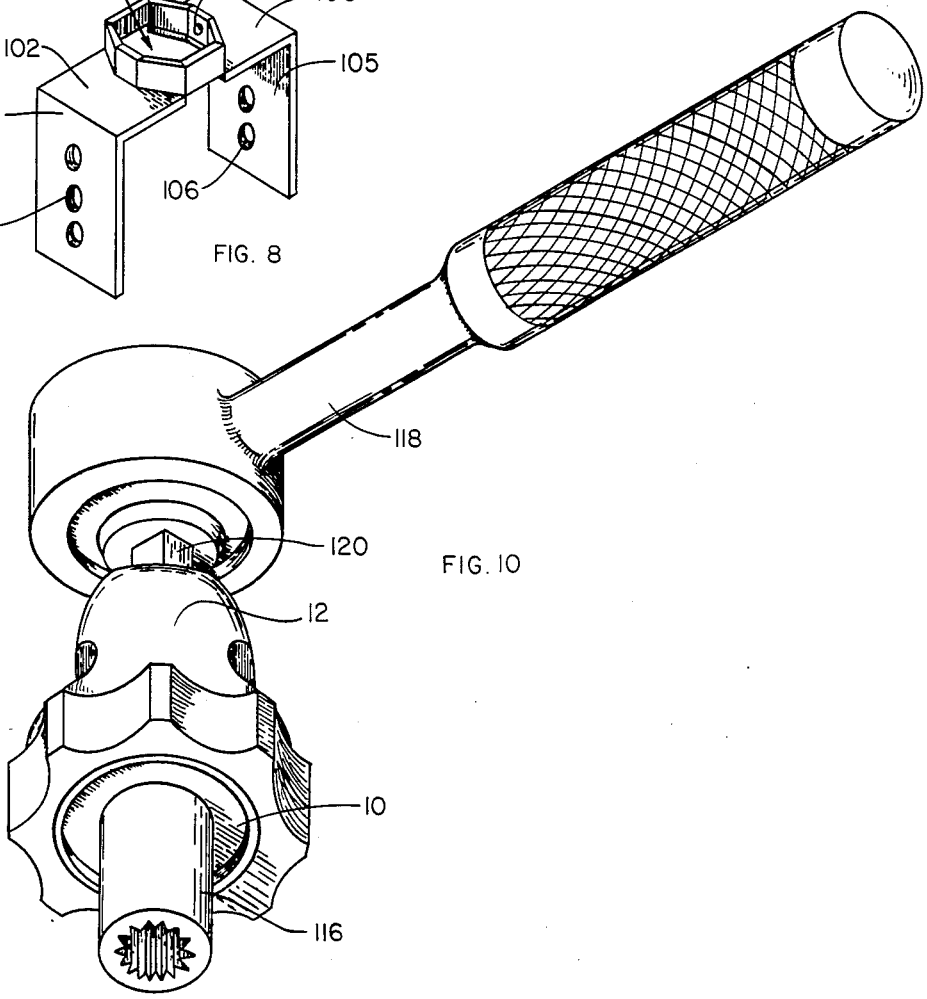
FIG. 10 is a perspective view of a ratchet wrench engaging the nested speed wrench and hand grip shown in FIG. 1.

Before turning to a description of complimentary hand grip 12 and its relationship with speed wrench 10, it should be appreciated that the improvement described above allows a user to gain additional mechanical advantage in rotating wrench 10 by means of numerous conventional wrenches or ratchet drives, such as shown in FIGS. 9 and 10. As is shown in FIG. 9, speed wrench 10 may be manipulated by means of a standard open end wrench 70 which has a wrench head 72 provided with a slot 74 sized to engage one of the pairs of flat sides 51–56. Since a drive head 30 is rigidly secured to casing 14, angular movement of wrench 70 about the axis of drive head 30 will rotate speed wrench 10 so that drive member 24 will rotate any tool piece secured thereto. Thus, the user may manually operate speed wrench 10 until the work piece is tightened to a desired degree. Then, the user may engage drive head 30 with wrench 70 without removing speed wrench 10 from the work piece so that additional torque may be applied to further tighten the work piece. Naturally, the converse of this procedure may be utilized to rotate the work piece in an opposite direction for loosening the work piece.

As noted above, a complimentary hand grip 12 is provided for use with speed wrench 10. The structure of hand grip 12, is shown in FIG. 1, but with greater detail in FIGS. 5–8. As is shown in these figures, hand grip 12 is constructed as a shell having an outer surrounding sidewall 80 and a cap portion 82. Cap portion 82 extends diametrically across shell 80 so that a pair of openings 84 and 86 are formed between cap portion 82 and shell 80. The outer surface of shell 80 is sculpted into flutings 88 to facilitate manipulation of hand grip 12.

Hand grip 12 is preferably formed out of an integrally molded high impact plastic material which is molded about a metal infrastructure 100, described more thoroughly below. An interior chamber 83 is therefore formed in the interior of shell 80, with interior chamber 83 being configured to receive speed wrench 10 in close fitted nested relation, as is shown in FIG. 10. To this end, cap portion 82 includes an open region 92 that is oriented along a central axis of hand grip 12 and is sized and configured to receive and engage drive head 30 of speed wrench 10. Accordingly, when wrench 10 is nested within hand grip 12, rotation of hand grip 12 about its central axis, which corresponds to the common axis of drive head 30 and drive member 24, causes rotation of speed wrench 10 since open region 92 directly engages drive head 30. Since shell 80 has a larger diameter to accommodate tool 10 and since flutings 88 project radially outwardly therefrom, the user gains mechanical advantage by employing hand grip 12.

As noted above, drive head 30 includes flattened positions 58 and 59 and, correspondingly, open region 92 has flat portions 94 and 95 which are sized to respectively engage flattened portions 58 and 59. This structure provides a registration means so that hand grip 12 may only be oriented on speed wrench 10 in two positions which correspond to an alignment of cap portion 82 with bail 32. By providing this registration structure, openings 84 and 86 of hand grip 12 match openings 44 and 46 of wrench 10 so that the user may manipulate reversing member 20 of wrench 10 even when hand grip 12 and wrench 10 are in the engaged or nested state. Naturally, other means for registration of the mating tool and grip are known in the art and contemplated by this invention.

Figure 7:
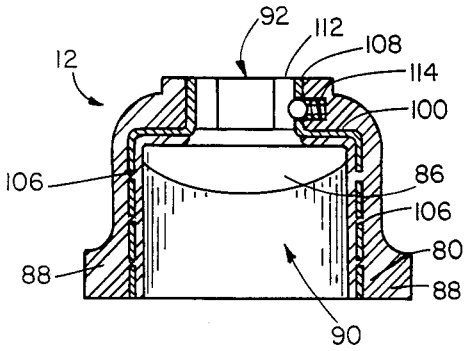
FIG. 7 is a cross-sectional view taken about lines 7—7 of FIG. 6.
Figure 8:
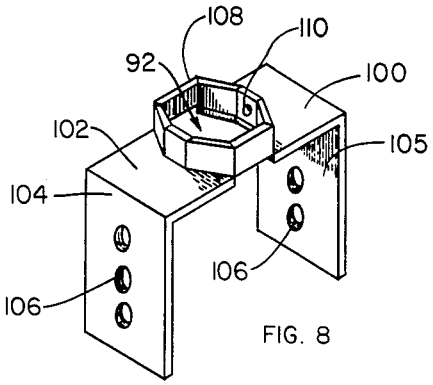
FIG. 8 is a perspective view of the infrastructure for the hand grip shown in FIG. 7.

As noted above, hand grip 12 is of plastic construction, such as polyvinylchloride, which is molded about infrastructure 100, with infrastructure 100 being best shown in FIG. 8. Infrastructure 100 is a metal strap-like member having a top portion 102 and a pair of downwardly depending legs 104 and 105. Legs 104 and 105 are provided with a plurality of ports 106. Open region 92 is formed by an upstanding rim 108 which is configured in the shape of drive head 30. As is best shown in FIG. 7, when the plastic material forming shell 80 and cap portion 82 are molded about infrastructure 100, the plastic material may flow through ports 106 so that the interior and exterior of shell 80 is mechanically bonded through ports 106. None of the plastic material, however, is molded on the interior of rim 108 so that open region 92 has inner surface defined by the inner surface of rim 108. In this manner, the perimeter of cavity 92 is formed of the metallic material, which is the preferable construction of infrastructure 100, so that hand grip 12 does not chip under stress that may occur when turning drive head 30 by means of rim 108 in cavity 92. In order to provide a detent means upon achieving the nested state between hand grip 12 and speed wrench 10, rim 108 is provided with a bore 110 that receives a ball 112 of a standard Jorgensen ball and spring element 114. Ball 112 is thus biased radially inwardly of open region 92 so that it will engage either dimple 60 or dimple 61 on flattened portions 58 and 59 of drive head 30.

It should be appreciated from the foregoing description, that the user may nest speed wrench 10 in drive head 12, as is shown in FIG. 10. In addition, drive member 24 may be attached to a work tool or work piece 116, which, as shown in FIG. 10, is a standard socket wrench set. The user may then manipulate hand grip 12 to rotate socket 16 in order to rotate a work piece. At such time that the user desires to gain mechanical advantage in turning socket 116, the user may directly engage cavity 66 of drive head 30 by means of a ratchet-type wrench 18, also as is shown in FIG. 10. It should be appreciated that wrench 118 has a conventional drive member or lug 120 that is sized to be inserted into cavity 66, and this mated insertion may be accomplished without removing hand grip 12 from speed wrench 10. Lug 120 is typically square shaped in cross section, but may take other geometrical shapes, such as a hexagonal cross section.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. In a tool adapted to rotatably drive a work piece wherein said tool includes a casing which mounts a drive mechanism having a drive member that projects axially from one side of the casing and that is adapted to selectively engage the work piece whereby rotation of said casing rotates said work piece, the improvement comprising a drive head rigidly attached to said tool and projecting axially from said casing on a second side thereof opposite said drive member, said drive head having a raised surface generally in a plane transverse to the common axis of said drive member and said drive head and having a plurality of flat exterior sides oriented along exterior planes which are parallel to said common axis, at least some of said exterior sides being parallel to one another, said drive head having an axial cavity formed in said raised surface, said cavity having a plurality of flat interior sidewalls oriented along interior planes which are parallel to said common axis, a bail member, extending across said casing on the second side thereof with said bail member having radial edges attached to an outer edge area of said casing, said casing, said bail member and said drive head being formed of an integral one-piece construction, and a hand grip sized to receive said tool in nested relation, said hand grip comprising a shell having an outer surrounding sidewall which engages said casing in a nested state and a cap portion rigidly attached to said surrounding sidewall, said cap portion having an axial opening configured and oriented to mateably receive said drive head in the nested state whereby said hand grip may be rotate said work piece.

2. The improvement according to claim 1 wherein said cavity is square in cross-section about a plane transverse to said common axis and is adapted to mateably engage a lug of an auxillary wrench whereby said auxillary wrench may be manipulated to apply leveraged mechanical torque to said drive member.

3. The improvement according to claim 1 wherein said drive head is directly attached to said casing.

4. The improvement according to claim 3 including a bail member extending across said casing on the second side thereof with said bail member having radial edges attached to said casing, said drive head being attached to said bail member.

5. The improvement according to claim 1 including detent means on said hand grip and tool for releaseably retaining said hand grip and tool in the nested stated.

6. The improvement according to claim 1 wherein said tool and said hand grip includes registration means for permitting the nested state only at selected relative rotational positions.

7. The improvement according to claim 1 wherein said hand grip is constructed of a unitary molded plastic body formed about a strap-like metal infrastructure, said opening being formed in said infrastructure whereby said drive head is directly engaged by the infrastructure.

8. The improvement according to claim 7 wherein said infrastructure includes leg portions extending from said openings into the surrounding sidewall of said shell, said leg portions including ports therein whereby the plastic forming the molded plastic body extends through said ports to mechanically lock said body to said infrastructure.

9. A speed wrench adapted to be both manually rotated about a central axis and selectively engaged by a wrenching tool having a working element in order to rotatably drive a tool that correspondingly drives a work piece, comprising:

a cylindrical casing having an exterior surface;

a reversible ratchet mechanism switchable between a first and second drive states corresponding to opposite rotational drive directions said drive mechanism being mounted in said casing and including a drive shaft projecting axially of said casing on a first side thereof adapted to couple a tool element whereby manual rotation of said casing will rotatably drive said drive shaft in a selected one of said drive directions;

a mechanical switch member connected to said ratchet mechanism between said first and second rotational drive states;

a bail member formed in a strap-like configuration extending across a second side of said casing opposite said drive shaft, said bail member having end portions rigidly attached to said casing to form access openings formed between said casing and said bail member thereby allowing access to said switch member and wherein outer exposed faces of said end portions form smooth, uninterrupted continuations of said exterior surface;

a drive head attached to said bail member along a common axis with said drive shaft, said drive head configured to be engaged by the working element of said wrenching tool whereby said casing may be rotated with increased mechanical advantages by said wrenching tool; and a hand grip sized to receive said tool in nested relation, said hand grip comprising a shell having an outer surrounding sidewall which engages said casing in a nested state and a cap portion rigidly attachd to said surrounding sidewall, said cap portion having an axial opening configured and oriented to mateably receive said drive head in the nested state whereby said hand grip may be rotated about said common axis to correspondingly rotate said work piece.

10. A speed wrench according to claim 9 wherein said drive head has a plurality of flat exterior sides oriented along exterior planes which are parallel to said common axis, at least some of said exterior sides being parallel to one another.

11. A speed wrench according to claim 10 wherein there are six exterior sides adapted to be engaged by said wrenching tool along the exterior of said drive head, said six exterior sides being organized as three parallel pairs of exterior sides in a generally hexagonal configuration.

12. A speed wrench according to claim 9 wherein said drive head has a cavity axially formed therein, and opening oppositely of said drive shaft, said cavity having a plurality of flat interior sidewalls oriented along interior planes which are parallel to said common axis, said wrenching tool having a lug adapted to be mateably received within said cavity.

13. The improvement according to claim 9 including detent means on said hand grip and tool for releaseably retaining said hand grip and tool in the nested state.

14. The improvement according to claim 9 wherein said tool and said hand grip includes registration means for permitting the nested state at selected relative rotational positions.

15. The improvement according to claim 9 wherein said hand grip is constructed of a unitary molded plastic body formed about a strap-like metal infrastructure, said opening being formed in said infrastructure whereby said drive head is directly engaged by the infrastructure.

16. The improvement according to claim 15 wherein said infrastructure includes leg portions extending from said openings into the surrounding sidewall of said shell, said leg portions including ports therein whereby the plastic forming the molded plastic body extends through said ports to mechanically lock said body to said infrastructure.

* * * * *